US010577137B2

(12) United States Patent
Nasiatka et al.

(10) Patent No.: US 10,577,137 B2
(45) Date of Patent: Mar. 3, 2020

(54) ELECTRICALLY POWERED COMBINATION HAND-HELD NOTCH-TYPE STRAPPING TOOL

(71) Applicant: Signode Industrial Group LLC, Glenview, IL (US)

(72) Inventors: Jason R. Nasiatka, Northbrook, IL (US); Janusz Figiel, Mundelein, IL (US); Wayne J. Skonieczny, Jr., Cary, IL (US)

(73) Assignee: Signode Industrial Group LLC, Glenview, IL (US)

( * ) Notice: Subject to any disclaimer, the term of this patent is extended or adjusted under 35 U.S.C. 154(b) by 0 days.

(21) Appl. No.: 15/369,012

(22) Filed: Dec. 5, 2016

(65) Prior Publication Data

US 2017/0166335 A1 Jun. 15, 2017

Related U.S. Application Data

(60) Provisional application No. 62/265,202, filed on Dec. 9, 2015.

(51) Int. Cl.
*B65B 13/02* (2006.01)
*B65B 13/34* (2006.01)
(Continued)

(52) U.S. Cl.
CPC ..... *B65B 13/025* (2013.01); *B65B 13/187* (2013.01); *B65B 13/305* (2013.01);
(Continued)

(58) Field of Classification Search
CPC ... B65B 13/025; B65B 13/187; B65B 13/305; B65B 13/345; B65B 13/188;
(Continued)

(56) References Cited

U.S. PATENT DOCUMENTS 1,891,239 A 12/1932 Ott
1,952,092 A 3/1934 Porter
(Continued)

FOREIGN PATENT DOCUMENTS

CA 657493 A 2/1963
CN 1330017 A 1/2002
(Continued)

OTHER PUBLICATIONS

International Search Report issued by ISA/EPO in connection with PCT/US2016/065128 dated Mar. 22, 2017.
(Continued)

*Primary Examiner* — Debra M Sullivan
(74) *Attorney, Agent, or Firm* — Levenfeld Pearlstein, LLC

(57) ABSTRACT

A strapping tool for tensioning overlapping sections of steel strap around a load and forming a notch-type seal in a seal element positioned over the overlapping sections of steel strap includes a body having a foot, a tensioning section and a sealing section. The tensioning section has a tensioner motor assembly operably mounted to the body. The tensioner motor assembly has an electrically powered tensioner motor. A tensioning wheel is operably connected to the tensioner motor. The sealing section has a notcher assembly that includes an electrically powered notcher motor operably mounted to the body. The notcher assembly includes a linkage and at least one pair of jaw elements. The linkage is configured to pivot ends of the jaw elements toward one another in a sealing cycle to form the notch-type seal in the seal element. A control system controls operation of the tensioner motor and the notcher motor. The control system is configured to operate the strapping tool in an automatic mode in which the tensioner motor and the notcher motor are
(Continued)

sequentially actuated by action of the control system by an operator.

18 Claims, 9 Drawing Sheets

(51) Int. Cl.
*B65B 57/00* (2006.01)
*B65B 13/18* (2006.01)
*B65B 13/30* (2006.01)
*B65B 13/22* (2006.01)
*B65B 57/02* (2006.01)

(52) U.S. Cl.
CPC ..... *B65B 13/345* (2013.01); *B65B 57/00* (2013.01); *B65B 13/22* (2013.01); *B65B 57/02* (2013.01)

(58) Field of Classification Search
CPC ..... B65B 13/22; B65B 13/34; B65B 13/327; B65B 13/16; B65B 13/185; B65B 13/87; B65B 13/30
USPC ..... 140/29, 32, 93.2, 123.6
See application file for complete search history.

(56) References Cited

U.S. PATENT DOCUMENTS 1,984,652 A 12/1934 Ott
1,988,534 A 1/1935 Abbott
2,040,576 A 5/1936 Timmerbeil
2,052,630 A 9/1936 Hoskwith
2,076,276 A 4/1937 Porter
2,350,474 A 6/1944 Lee
2,801,558 A 8/1957 Crosby et al.
2,915,003 A 12/1959 Crosby et al.
2,915,004 A 12/1959 Leslie
2,933,958 A 4/1960 Koehler et al.
2,936,156 A 5/1960 Coupland
2,936,456 A 5/1960 Henry
3,040,606 A 6/1962 Ericsson
3,103,955 A 9/1963 Ericsson et al.
3,144,888 A 8/1964 Palmer
3,150,694 A 9/1964 Meier
3,194,281 A 7/1965 Frey et al.
3,211,186 A 10/1965 Bushman
3,319,666 A 5/1967 Victor et al.
3,333,608 A 8/1967 Kuoni
3,396,760 A 8/1968 Kirsinas et al.
3,411,551 A 11/1968 Plattner
3,506,041 A 4/1970 Angarola
3,599,328 A 8/1971 Ursetta
3,654,033 A 4/1972 Angarola
3,710,445 A 1/1973 Roth
3,769,859 A 11/1973 Staron
3,863,684 A 2/1975 Simmons
4,062,278 A 12/1977 Cheung
4,069,583 A 1/1978 Stubbings
4,154,158 A 5/1979 Leslie et al.
4,159,725 A 7/1979 Bachmann et al.
4,245,678 A 1/1981 Sansum
4,250,784 A 2/1981 Bredow
4,282,907 A 8/1981 Massion et al.
4,313,779 A 2/1982 Nix
4,356,845 A 11/1982 Kimbrough
4,378,262 A 3/1983 Annis, Jr.
4,595,433 A 6/1986 Ford et al.
4,742,742 A 5/1988 Yokoe
4,756,085 A 7/1988 Lebessis
4,791,968 A 12/1988 Pearson
4,934,416 A 6/1990 Tonkiss
4,949,668 A 8/1990 Heindel et al.
5,133,532 A 7/1992 Figiel et al.
5,169,480 A 12/1992 Toppel et al.
5,195,413 A 3/1993 Johnson et al.
5,235,750 A 8/1993 Brown
5,279,336 A * 1/1994 Kusakari ..... E04G 21/123 140/57
5,333,438 A 8/1994 Gurak et al.
5,380,393 A 1/1995 Drabarek et al.
5,476,569 A 12/1995 Harada
5,483,998 A 1/1996 Marelin et al.
5,518,043 A 5/1996 Cheung et al.
5,566,726 A 10/1996 Marelin
5,632,851 A 5/1997 Young
5,694,749 A 12/1997 Oseland
5,694,984 A 12/1997 Cheung
5,738,152 A 4/1998 Crittenden
5,828,977 A 10/1998 Hayashi
5,853,524 A 12/1998 Nix
5,882,573 A 3/1999 Kwok et al.
5,903,462 A 5/1999 Wagner et al.
5,954,899 A 9/1999 Figiel et al.
6,073,664 A 6/2000 Angarola
6,079,457 A 6/2000 Crittenden
6,308,745 B1 10/2001 Angarola et al.
6,308,760 B1 10/2001 Finzo et al.
6,338,184 B1 1/2002 Angarola et al.
6,338,375 B1 1/2002 Harada
6,354,336 B1 3/2002 LeBan
6,354,580 B1 3/2002 Nagai et al.
6,422,272 B1 7/2002 Crittenden
6,470,941 B1 10/2002 Wehr
6,533,013 B1 3/2003 Nix
6,698,460 B2 3/2004 Marsche
6,732,638 B1 5/2004 Rometty et al.
6,895,733 B2 5/2005 Nix
6,907,717 B2 6/2005 Nix
6,918,235 B2 7/2005 Nix
6,966,255 B1 11/2005 Crittenden
7,073,430 B2 7/2006 Kimmerle
7,155,885 B1 1/2007 Nasiatka et al.
7,299,103 B1 11/2007 Dye
7,431,682 B2 10/2008 Zeiler et al.
7,438,094 B2 10/2008 Hillegonds et al.
7,497,068 B2 3/2009 Nasiatka et al.
7,556,129 B2 7/2009 Nix
7,562,620 B1 7/2009 Nasiatka et al.
7,740,425 B2 6/2010 Zeiler et al.
8,051,881 B2 11/2011 Segroves
8,264,374 B2 9/2012 Obatake et al.
8,281,711 B2 10/2012 Haberstroh et al.
8,412,179 B2 4/2013 Gerold et al.
8,655,541 B2 2/2014 You
8,981,960 B2 3/2015 Sakurai
9,055,033 B2 6/2015 Mergener
9,085,070 B2 7/2015 Skonieczy et al.
9,272,799 B2 3/2016 Figiel et al.
9,430,370 B2 8/2016 Mergener
9,466,198 B2 10/2016 Burch et al.
9,467,862 B2 10/2016 Zeiler et al.
10,322,831 B2 * 6/2019 Nasiatka ..... B65B 13/345
2002/0129866 A1 9/2002 Czebatul et al.
2002/0139085 A1 10/2002 Kasel
2002/0148274 A1 10/2002 Goop
2002/0185514 A1 12/2002 Adams et al.
2003/0230058 A1 * 12/2003 Nix ..... B65B 1/28 53/582
2004/0200191 A1 10/2004 Armstrong et al.
2004/0237807 A1 12/2004 Pearson
2005/0000586 A1 1/2005 Zeimetz et al.
2005/0115081 A1 6/2005 Tu
2005/0242108 A1 11/2005 Harris et al.
2005/0252570 A1 11/2005 Nasiatka et al.
2006/0272381 A1 12/2006 Ayer et al.
2008/0289516 A1 11/2008 Takidis et al.
2008/0313452 A1 12/2008 Qin et al.
2009/0114308 A1 5/2009 Marelin et al.
2010/0132827 A1 6/2010 Chen
2010/0139805 A1 6/2010 Sledzinski
2011/0056390 A1 * 3/2011 Neeser ..... B65B 13/025 100/29
2011/0056391 A1 3/2011 Neeser et al.

(56) References Cited

U.S. PATENT DOCUMENTS

| | | | |
|---|---|---|---|
| 2011/0056392 | A1 | 3/2011 | Neeser et al. |
| 2011/0100233 | A1 | 5/2011 | Neeser et al. |
| 2011/0132058 | A1 | 6/2011 | Barlasov et al. |
| 2011/0155277 | A1 | 6/2011 | Coles et al. |
| 2011/0214292 | A1 | 9/2011 | Heh |
| 2011/0314680 | A1 | 12/2011 | Zhang |
| 2012/0067450 | A1 | 3/2012 | Shafer |
| 2012/0210682 | A1 | 8/2012 | Gardner et al. |
| 2012/0299727 | A1 | 11/2012 | Newman et al. |
| 2013/0085053 | A1* | 4/2013 | Figiel ..... B65B 13/025 493/84 |
| 2013/0240122 | A1 | 9/2013 | Adams |
| 2013/0269824 | A1 | 10/2013 | Skonieczny et al. |
| 2013/0327438 | A1 | 12/2013 | Sledzinski |
| 2014/0006295 | A1 | 1/2014 | Zeiler et al. |
| 2014/0007781 | A1 | 1/2014 | Sikora et al. |
| 2014/0048522 | A1 | 2/2014 | Dina et al. |
| 2014/0060345 | A1 | 3/2014 | Figiel et al. |
| 2014/0083311 | A1 | 3/2014 | Bonifazi et al. |
| 2014/0119575 | A1 | 5/2014 | Conrad et al. |
| 2014/0165410 | A1 | 6/2014 | Johnson et al. |
| 2014/0240902 | A1 | 8/2014 | Burch |
| 2014/0262389 | A1 | 9/2014 | Simeone et al. |
| 2014/0290179 | A1 | 10/2014 | Keller |
| 2015/0033959 | A1 | 2/2015 | Finzo |
| 2015/0034206 | A1 | 2/2015 | Finzo |
| 2015/0210411 | A1 | 7/2015 | Finzo et al. |
| 2015/0246739 | A1 | 9/2015 | Finzo et al. |
| 2015/0321777 | A1 | 11/2015 | Nasiatka et al. |
| 2016/0088482 | A1 | 3/2016 | Zeiler et al. |
| 2016/0107775 | A1* | 4/2016 | Amacker ..... B65B 13/22 100/29 |
| 2016/0107776 | A1 | 4/2016 | Amacker et al. |
| 2016/0311094 | A1 | 10/2016 | Mergener et al. |
| 2016/0325391 | A1 | 11/2016 | Stampfl et al. |
| 2016/0342151 | A1 | 11/2016 | Dey et al. |
| 2016/0364326 | A1 | 12/2016 | Mergener |
| 2016/0364687 | A1 | 12/2016 | Matson et al. |
| 2016/0373457 | A1 | 12/2016 | Matson et al. |
| 2017/0006420 | A1 | 1/2017 | Burch et al. |

FOREIGN PATENT DOCUMENTS

| | | | |
|---|---|---|---|
| CN | 1388040 | A | 1/2003 |
| CN | 2813452 | Y | 9/2006 |
| CN | 200942881 | Y | 9/2007 |
| CN | 200951836 | Y | 9/2007 |
| CN | 201023675 | Y | 2/2008 |
| CN | 201172485 | Y | 12/2008 |
| CN | 101391661 | A | 3/2009 |
| CN | 201411057 | Y | 2/2010 |
| CN | 102026874 | A | 4/2011 |
| CN | 101391661 | B | 6/2011 |
| CN | 202244155 | U | 5/2012 |
| CN | 102514025 | A | 6/2012 |
| CN | 202491949 | U | 10/2012 |
| CN | 102773871 | A | 11/2012 |
| DE | 1185532 | B | 1/1965 |
| DE | 1922327 | U | 8/1965 |
| DE | 1536210 | B | 9/1970 |
| DE | 29507452 | U1 | 7/1995 |
| DE | 102009001544 | A1 | 10/2010 |
| EP | 0703146 | A1 | 3/1996 |
| EP | 1413519 | A1 | 4/2004 |
| EP | 1525958 | A1 | 4/2005 |
| EP | 1582462 | A1 | 10/2005 |
| EP | 1582463 | A2 | 10/2005 |
| EP | 2540631 | A1 | 1/2013 |
| FR | 2659622 | A1 | 9/1991 |
| GB | 896398 | A | 5/1962 |
| JP | 2008213052 | A | 9/2008 |
| JP | 2009022593 | A | 2/2009 |
| KR | 19900002395 | | 3/1990 |
| NL | 111543 | C | 2/1965 |
| NL | 128559 | C | 11/1969 |
| WO | 2011008390 | A1 | 1/2011 |
| WO | 2014179895 | A2 | 11/2014 |

OTHER PUBLICATIONS

International Preliminary Report on Patentability issued by International Bureau in connection with PCT/US2016/065128 dated Jun. 21, 2018.

Office Action issued by EPO in connection with European Application No. 16816829.2 dated Apr. 24, 2019.

Signode, Series M20 Automatic Power Strapping Machine Head, Operation Parts and Safety Manual, Nov. 1981, vol. 1, U.S.A.

Signode, Series M20 Automatic Power Strapping Machine, Operation Parts and Safety Manual, Nov. 1981, vol. 2A, U.S.A.

Signode, M20-SV Automatic Power Strapping Machine Head, Operation Parts and Safety Manual, Apr. 1988, vol. 2B, U.S.A.

Signode, M20 Double Notch Automatic Power Strapping Machine Head, Operation Parts and Safety Manual, Mar. 1988, vol. 2C, U.S.A.

Signode, M20 Single Notch Automatic Power Strapping Machine Head, Operation Parts and Safety Manual, Mar. 1998, U.S.A.

Midwest Industrial Packaging, MIP-GRIP-1141 battery powered tensioner. Copyright 2014.

PAC Strapping Products Inc., Plastic Strapping Tools VT550L and VT700L. Copyright 2011.

Signode RCNS2-34 and RCNS2-114 Pneumatic Sealers for Steel Strapping, Catalog SPD 1465 REV Jan. 20, 2010.

Signode, BXT2-19 Battery Powered Combination Tool. Copyright 2015.

Signode, BXT2-25/32 Battery Powered Combination Tool. Copyright 2015.

* cited by examiner

ELECTRICALLY POWERED COMBINATION HAND-HELD NOTCH-TYPE STRAPPING TOOL

CROSS-REFERENCE TO RELATED APPLICATION DATA

This application claims the benefit of and priority to Provisional U.S. Patent Application Ser. No. 62/265,202, filed Dec. 9, 2015, the disclosure of which is incorporated herein in its entirety.

BACKGROUND

Strapping tools or strappers come in a wide variety of types, from fully manual hand tools to automatic, table-top machines. Strapping tools can be designed and intended for use with different types of strap or strapping materials, such as metal strapping or plastic/polymeric strapping. Strappers for metal strapping materials can be automatic table-top or hand-held devices that are configured to seal the strap onto itself. The sealing function can be performed using a sealless configuration by forming interlocking keys in overlapping courses of the strap, or by applying a seal that is positioned over and crimped onto and cut into the overlapping strap courses.

Known hand-held devices for steel strap include manual tools that require an operator to exert one or more forces to tension the strap and form the seal, pneumatically operated tools that perform the tension and sealing functions by actuation of one or more pneumatic motors and portable, electrically operated tools, such as battery operated tools. The manual tools can be fatiguing to operate for long periods of time and may be difficult to maneuver and manipulate in certain instances, for example when the seal is formed on the side of a package or load. Moreover, manual sealing typically requires multiple tools to tension the strap, form the seal and cut the sealed strap from its source.

Pneumatic tools, such as that disclosed in Crittenden, U.S. Pat. No. 6,079,457, commonly assigned with the present application and incorporated herein in its entirety by reference, function well; however, they require a source of compressed gas, such as air, and thus necessitate the use of hoses, compressed gas fittings and the like for operation. As such, the use of pneumatic tools may be limited in certain applications where, for example, the strapping operations are carried out at different locations throughout a manufacturing facility. Moreover, pneumatic tools employ pneumatic motors which can be costly, and pneumatic circuits which can be complex and require casting and machining operations in the manufacture of pneumatic circuit modules.

Electrically operated notch-type tools are known, however, such tools either tension strap or seal strap, but do not perform both functions in a single tool.

Accordingly, there is a need for a powered notch-type strapping tool that functions to tension strap around a load, form a notch-type seal in the overlapping courses of strap material and cut the sealed strap from its source. Desirably, such a tool is self-contained, is electrically and/or battery powered, and is thus portable and can be used throughout a facility at any location. More desirably still, such a tool can be used in a variety of operating modes.

SUMMARY

Various embodiments of the present disclosure provide a strapping tool for tensioning and forming a notch-type joint in overlapping sections of steel strap around a load. The tool includes a body having a foot, a tensioning assembly operably mounted to the body and a sealing assembly operably mounted to the body. The tensioning and sealing assemblies have electrically powered motors. A tensioning wheel is operably connected to the tensioner motor.

The sealing section has a notcher assembly that includes an electrically powered notcher motor. The notcher assembly has a linkage and at least one pair of jaw elements. In an embodiment the notcher assembly has multiple pairs of jaw elements. The linkage is configured to pivot the ends of the jaw elements toward one another in a sealing cycle to form the notch-type seal in the seal element. In an embodiment with multiple pairs of jaw elements, one or more pairs of the jaw elements can be engaged and disengaged so that a desired number of pairs of jaw elements open and close during the sealing cycle.

A control system controls operation of the tensioner motor and the notcher motor. The control system is configured to operate the strapping tool in an automatic mode in which the tensioner motor and the notcher motor are sequentially actuated by action of the control system by an operator. In an embodiment, such action is a single action, for example, a single depression of an actuation switch or button. In an embodiment, such action is multiple depressions of an actuation switch or button.

In an embodiment, the tensioner motor assembly is pivotally mounted to the body relative to the foot to permit readily positioning the overlapping course of strap the tool. In such an embodiment, the tensioner motor assembly biased to move the tension wheel toward the foot to retain the strap captured between the tension wheel and the foot.

In an embodiment, the tool includes an actuation switch for controlling the tool. The actuation switch is operably connected to control system to control operation of the tensioner motor and the notcher motor.

In one embodiment, the sealing section includes one pair of jaw elements and notch plates positioned on either side of the pair of jaw elements. In another embodiment, the sealing section includes two pairs of jaw elements and notch plates positioned between and on either side of the pairs of jaw elements.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
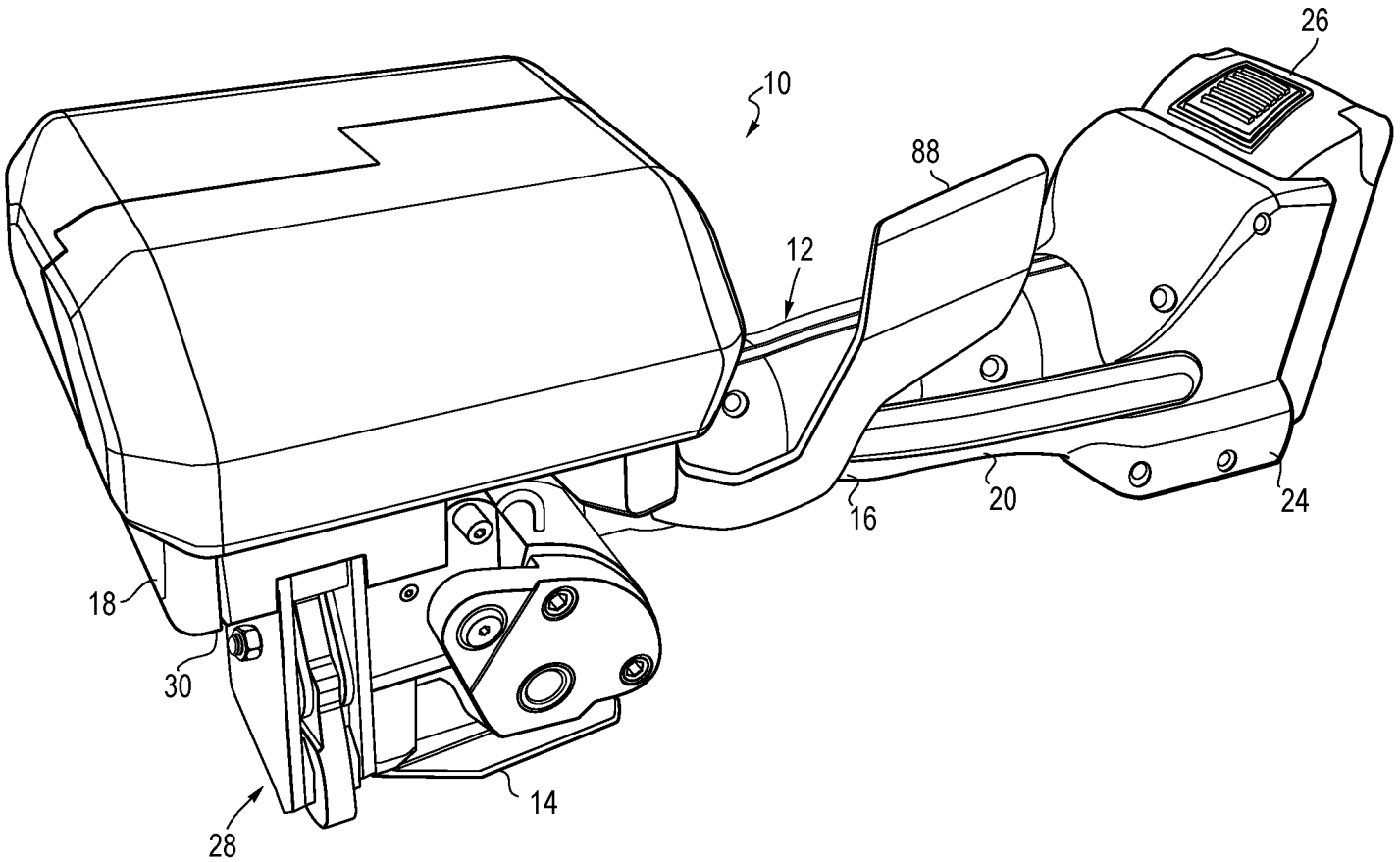
FIG. 1 is an illustration of an embodiment of an electrically powered combination hand-held notch-type strapping tool.
Figure 2:
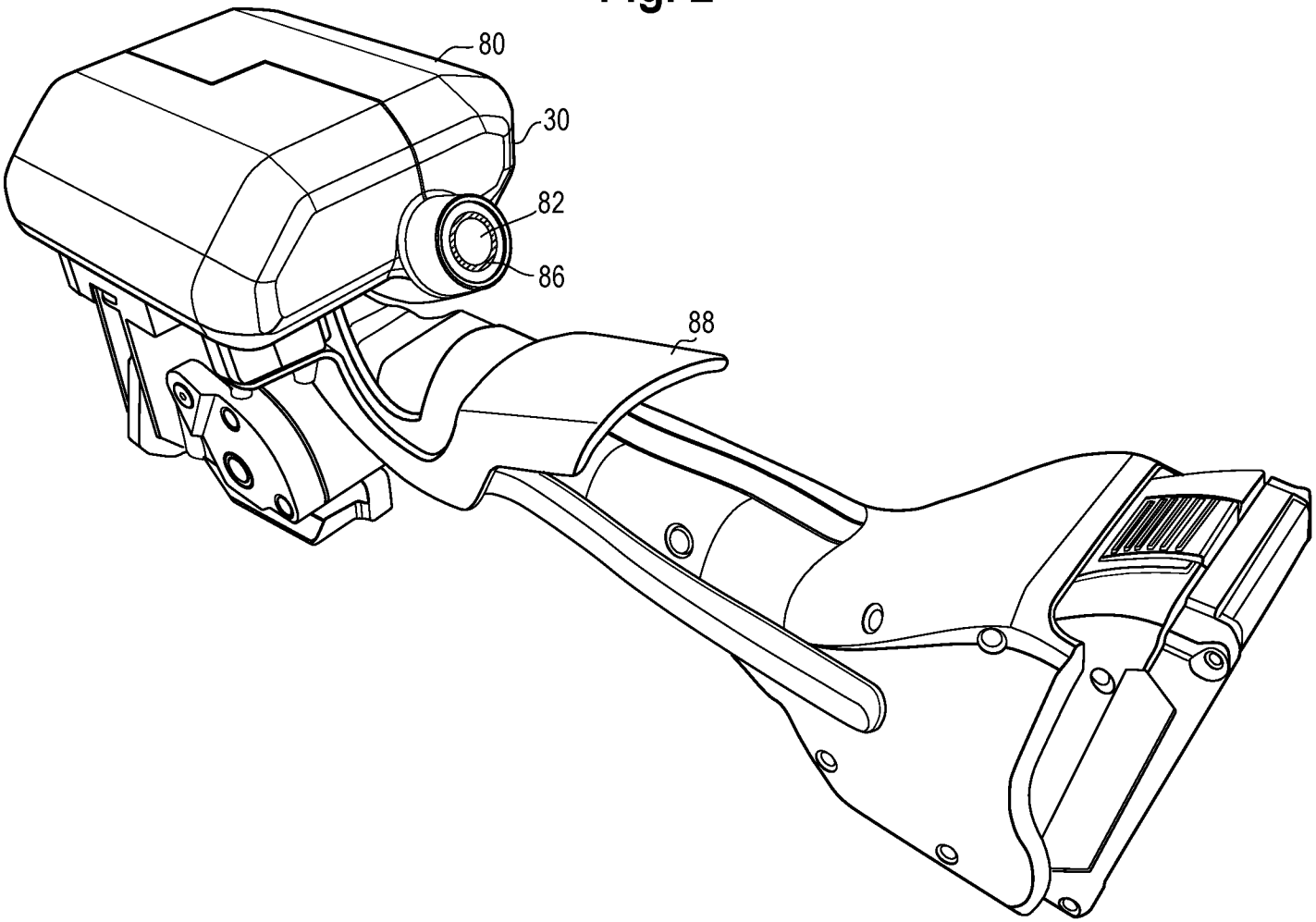
FIG. 2 is another perspective view of the tool.
Figure 3:
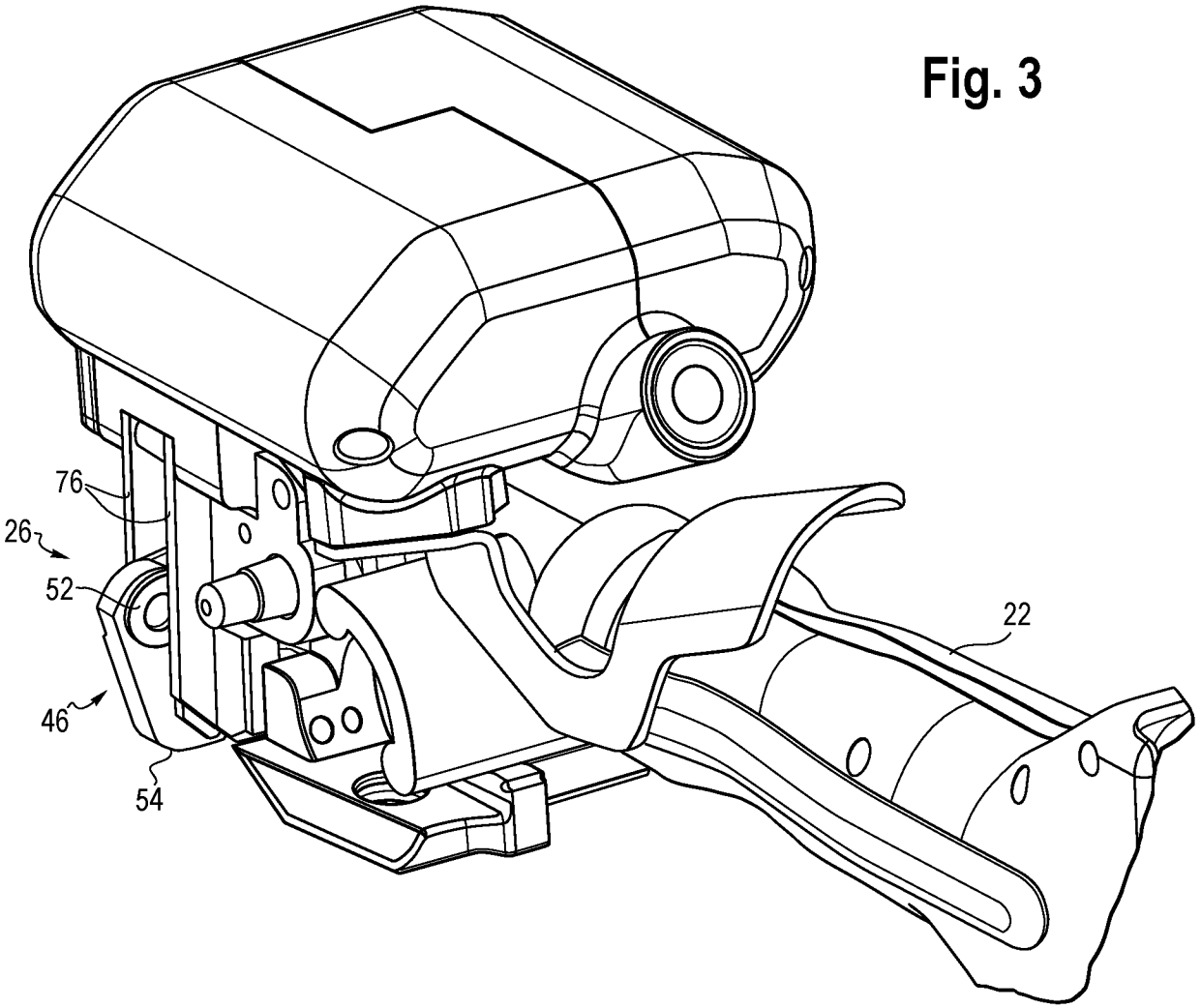
FIG. 3 an illustration of the tool with a portion of the tensioning assembly removed for clarity of illustration.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Referring now to the figures, an embodiment of the electrically powered combination notch-type strapping tool 10 is shown. The tool 10 is configured to tension steel strap or strapping material around an object or load, crimp a seal element onto the overlapping portions of the strap and cut and bend tabs in the seal element and strap to form a sealed tensioned loop around the load. Generally, the strap includes a feed or supply end and a free end that is fed around the load and reinserted into the tool with the seal element to overlap the supply end. Such a notch-type seal and a tool for forming such seals are disclosed in Figiel, U.S. Pat. No. 9,272,799, and Nasiatka, U.S. patent application Ser. No. 14/689,471 (U.S. Publication 2015/0321777), the disclosures of which are incorporated herein in their entirety.

The tool 10 includes a body 12 having a foot 14, a tensioning section 16 and a sealing section 18. The tensioning section 16 includes a housing 20 and a first or tensioner motor assembly 22 operably mounted within the tensioning section housing 20. A receiver 24 is formed as part of or mounted to the tensioning section housing 20 for receiving a battery 26 or other power source. The sealing section 18 of the tool includes a notcher assembly 28 having a housing 30 and a second or notcher motor assembly 32 mounted within the notcher housing 30.

Referring to FIGS. 3-8, the tensioning section 16 includes the tensioner motor assembly 22, which has a motor, such as a DC motor, and a gear set to convert the motor output drive to a usable speed. The gear set can include a planetary gear set to reduce the output speed and to increase the output power or torque from the motor. The gear set includes a final drive (not shown) that meshes with a gear (not shown) on a tension wheel 40. The tension wheel 40 is mounted normal to the final drive. The gear set and final drive are housed in a gear housing 42 mounted to the tool body 12. A gripping pad 44 can be positioned on the foot 14, opposite the tension wheel 40.

The tensioner motor assembly 22, gear housing 42 and tension wheel 40 are movably mounted to the body 12 to move the tension wheel 40 toward and away from the foot 14. This permits the tool 10 to be opened to position the strap between the foot 14 and the tension wheel 40. In an embodiment, the tensioner motor assembly 22, gear housing 42 and tension wheel 40 are pivotably mounted to the body 12 to pivot the tension wheel 40 toward and away from the foot 14. The tensioner motor assembly 22, gear housing 42 and tension wheel 40 can be biasedly mounted to the body 12, such as by a spring (not shown), to bias the tension wheel 40 toward the foot 14 and into contact with the strap when the tool 10 is in the closed position.

FIGS. 4-6 and 9-12 illustrate an embodiment of the sealing section 18. The sealing section 18 includes a notcher assembly 46 having, generally, a drive wheel 48, a first link 50 eccentrically mounted to the drive wheel 48, a pair of jaw 52 links pivotally mounted to the first link 50 and a pair of jaw elements 54 mounted to the jaw links 52.

The drive wheel 48 is driven by a drive motor 34. In an embodiment, the motor 34 is connected to the drive wheel 48 by a drive belt 58 via a gear set 36 that can include a planetary gear set 38 to reduce the output speed and to increase the output power or torque from the motor 34. Those skilled in the art will recognize other configurations of drive train, such as direct gearing that can be used to drive the drive wheel, which other drive trains are within the scope and spirit of the present disclosure. In an embodiment, the drive wheel 48 is an overrun clutch, such as that disclosed in the aforementioned application to Nasiatka.

Figure 4:
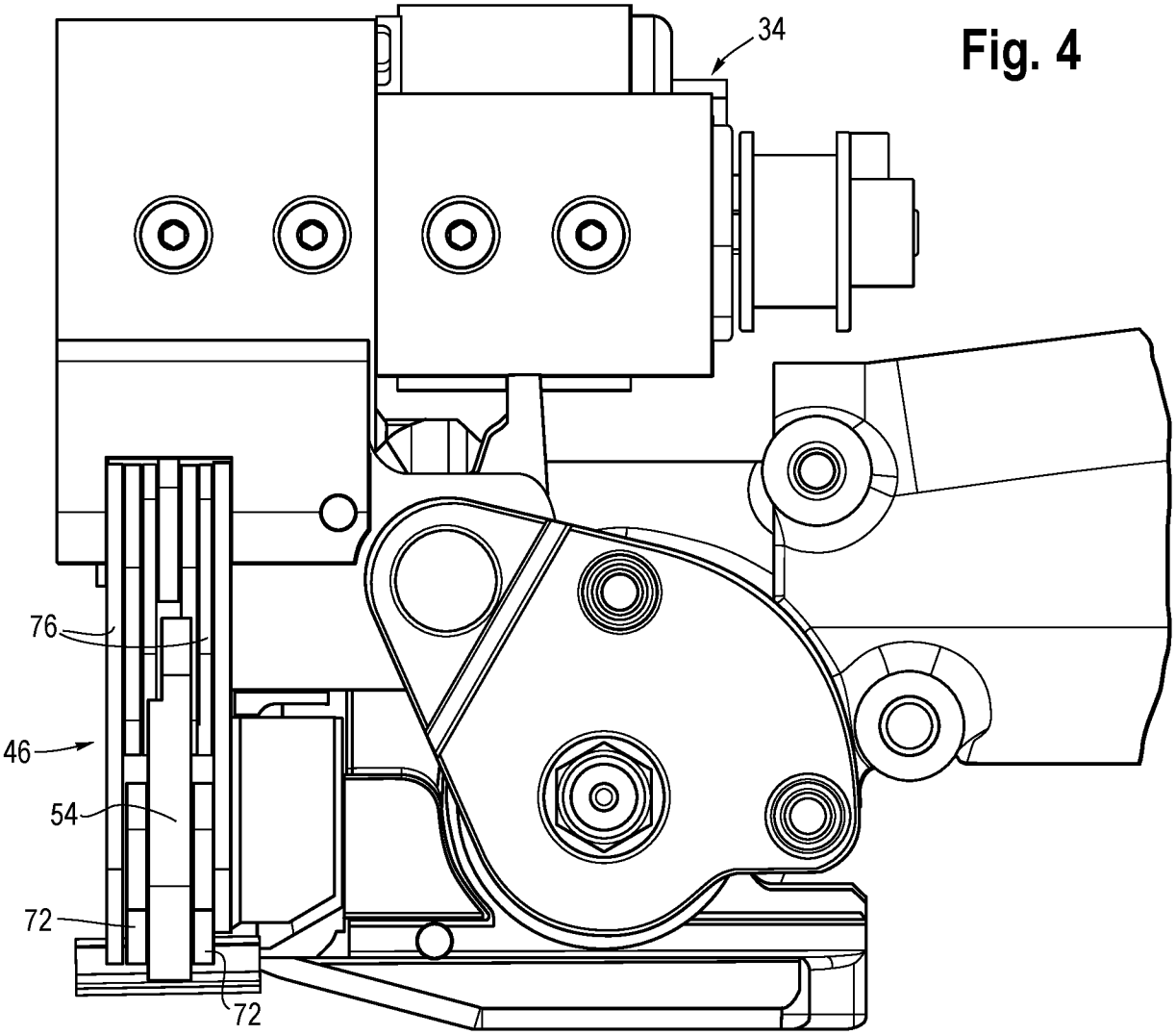
FIG. 4 is an enlarged, partial side view of the tool illustrating the tensioning and sealing sections.
Figure 5:
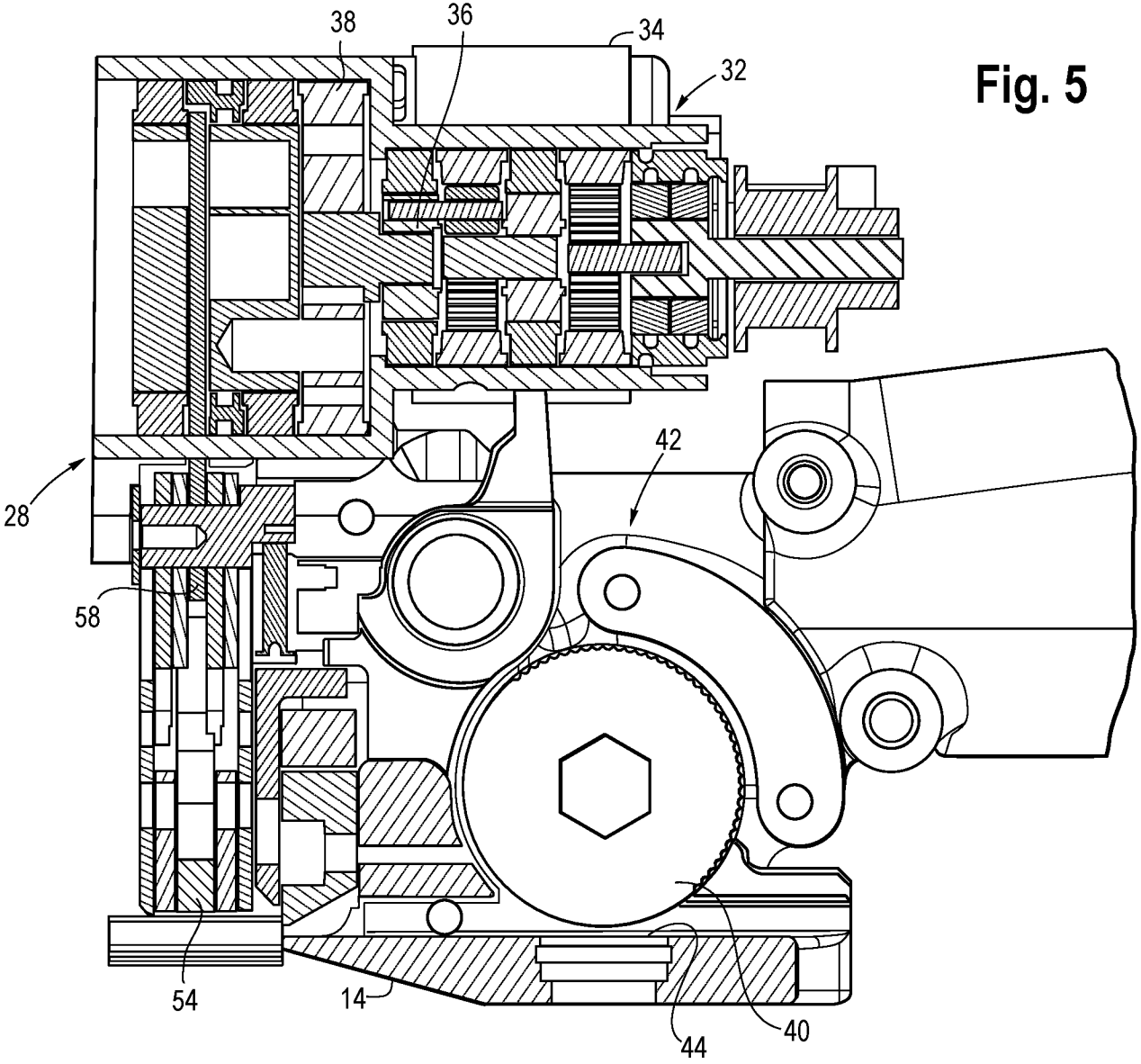
FIG. 5 is a side sectional view similar to FIG. 4.
Figure 6:
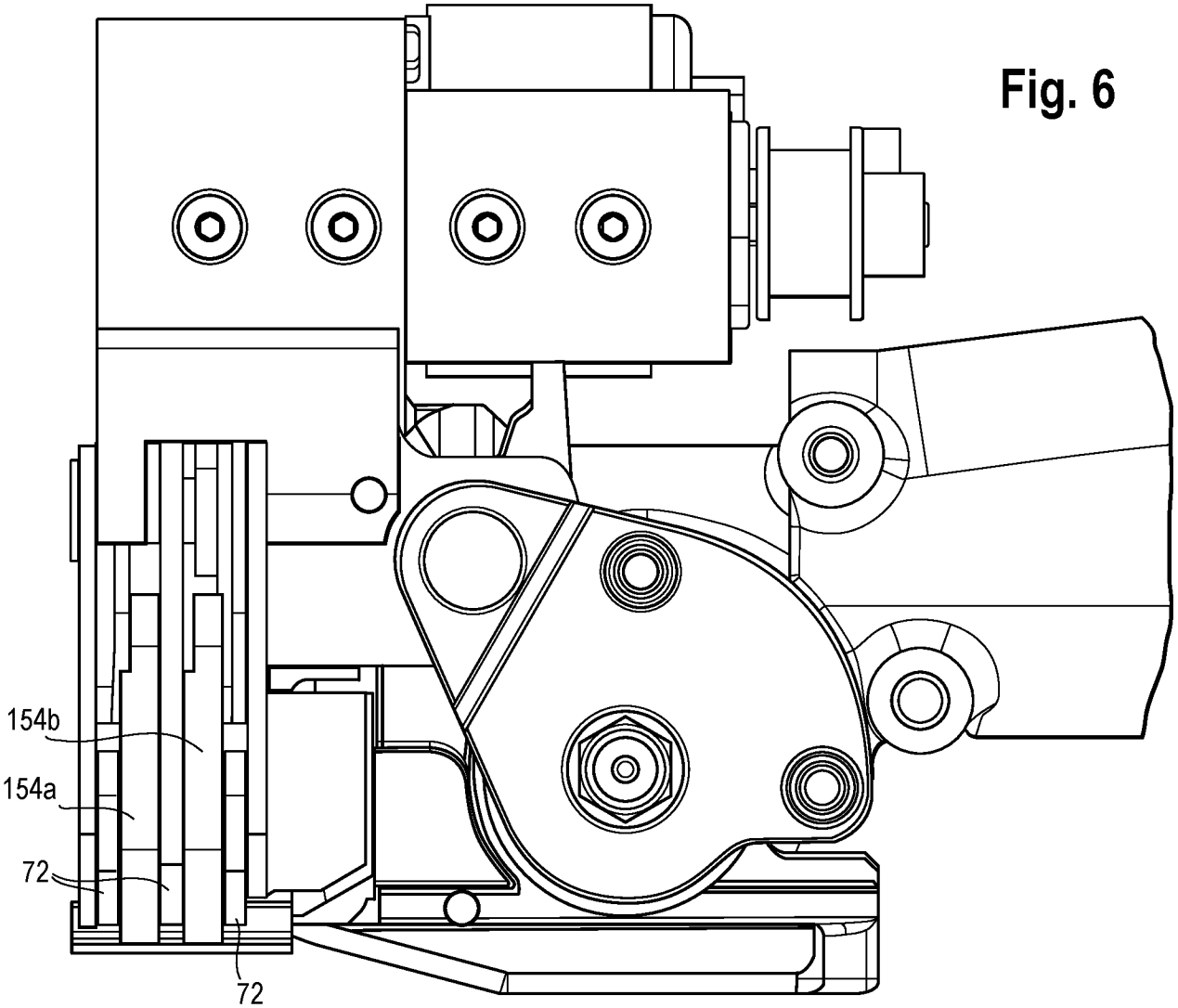
FIG. 6 is an enlarged, partial side view of another embodiment of the tool illustrating the tensioning and sealing sections.
Figure 7:
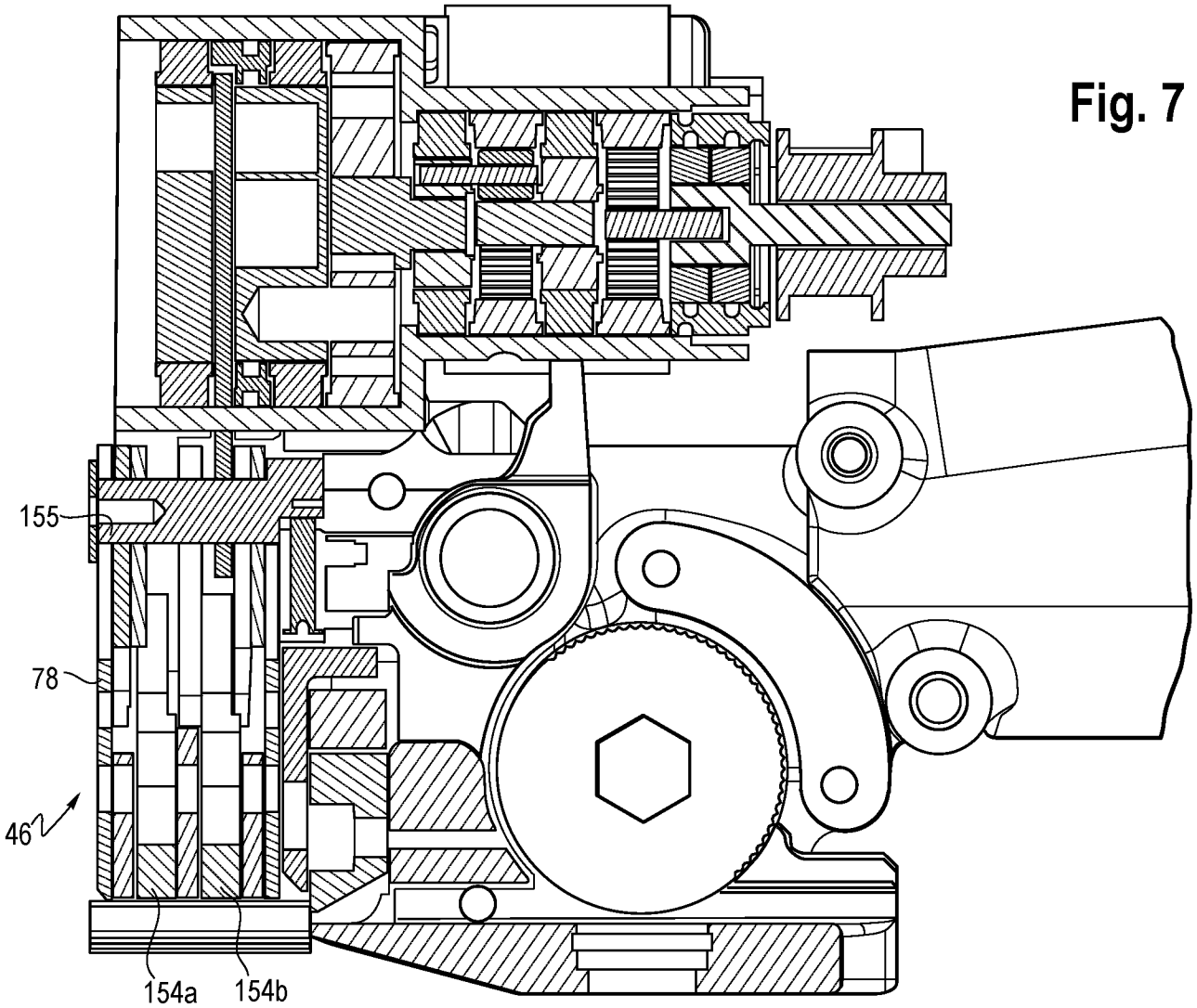
FIG. 7 is a side sectional view of the tool of FIG. 6.
Figure 8:
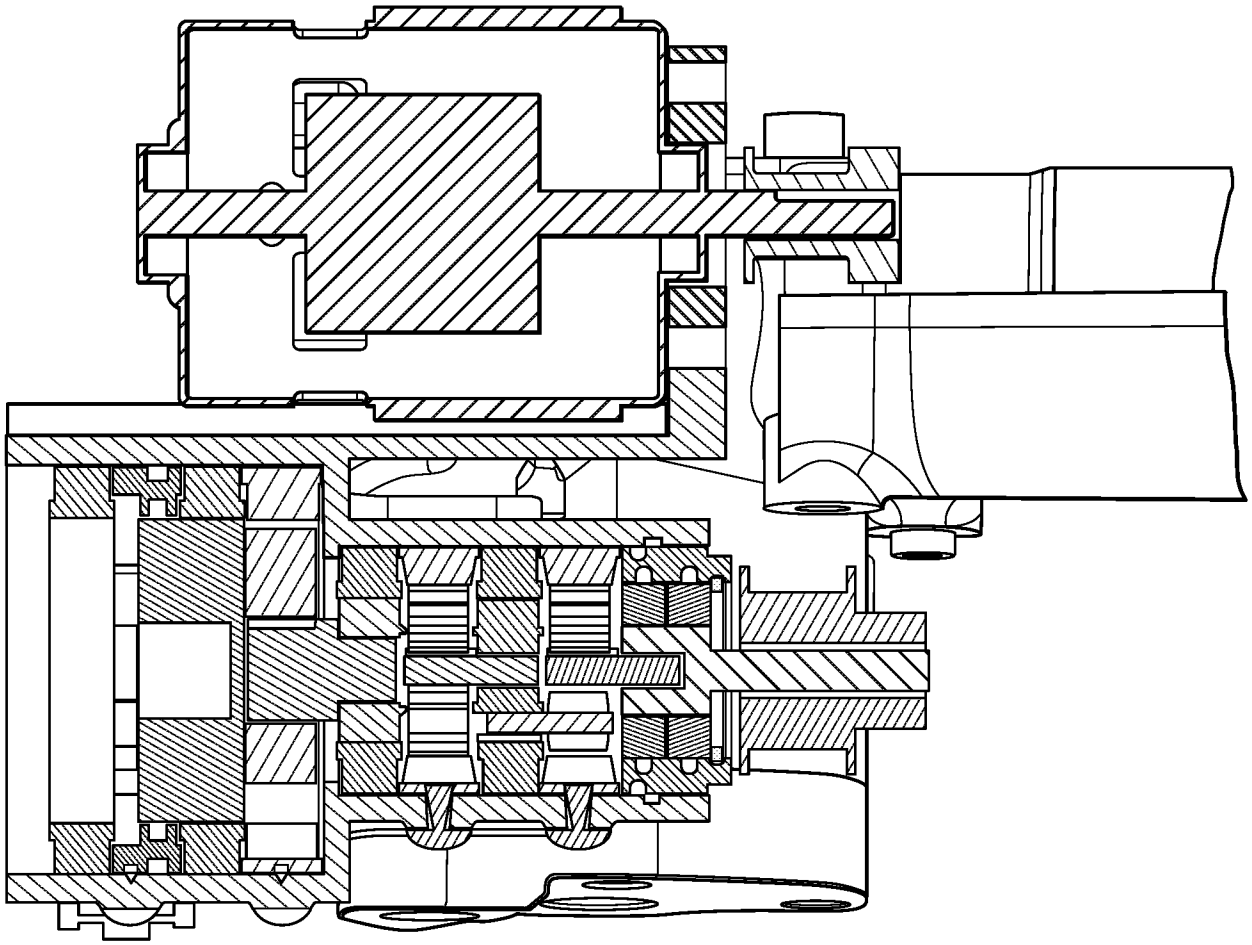
FIG. 8 is a top sectional view of the tool of FIGS. 4 and 5.

The first link 50 is eccentrically mounted to the drive wheel 48 by a first pin 60. The pair of jaw links 52 are pivotally mounted to the first link 50 by a second pin 62. The jaw links 52 extend between the first link 50 and the jaw elements 54. Each jaw element 54 includes a first opening 64, a second opening (not shown) and a tapered pincer end 68. In an embodiment, as shown in FIGS. 4 and 5, the notcher assembly 46 includes a pair of opposing jaw elements 54. In another embodiment, as illustrated in FIGS. 6 and 7, the tool 10 includes multiple pairs of jaw elements 154*a*, 154*b*. Each pair of jaw elements 54, 154 elements is pivotally mounted to its respective jaw link 52 by a third pin 70.

Figure 10:
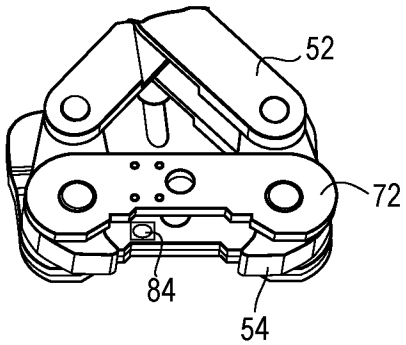
FIG. 10 is a bottom perspective view of the sealing section showing the notchers.
Figure 12:
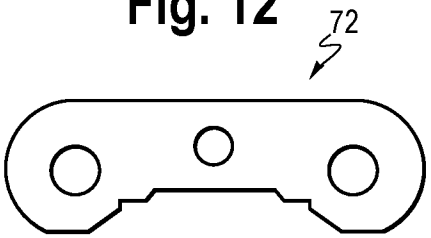
FIG. 12 is an illustration of one embodiment of a notch plate.
Figure 9:
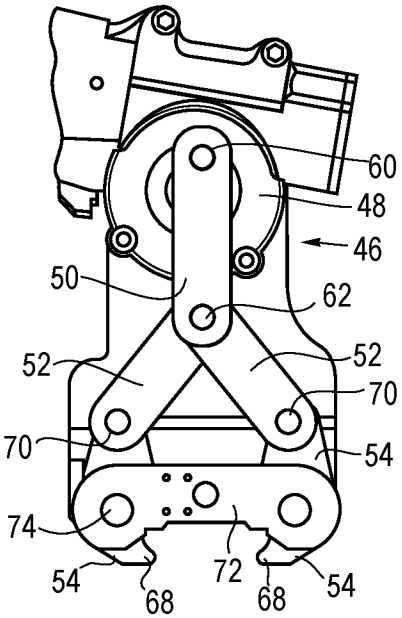
FIG. 9 illustrates the sealing section linkages.
Figure 11:
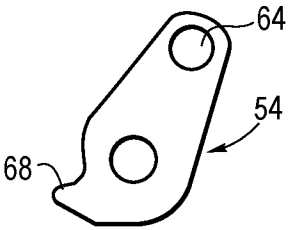
FIG. 11 is an illustration of one embodiment of a jaw element.

The jaw elements 54 are mounted to, and operably connected to each other, by notchers 72, an example of which is shown in FIGS. 9, 10 and 12. The jaw elements 54 are mounted to the notchers 72 by respective fourth pins 74. In this configuration, as the drive wheel 48 rotates, the first link 50 rotates with the wheel 48 which in turn moves a second end of the first link 50 in a generally reciprocating manner. The jaw links 52, which are mounted pivotally to the second end the first link 50, move in a generally downward and outward arc, which in turn opens and closes the jaw elements 54.

In an embodiment, the notcher assembly 46 includes side plates 76 that contain the drive wheel 48, the jaw elements 54, the first link 50 and jaw links 52, and the notchers 72. The side plates 76 can also include a slotted 78 opening and the second pin 62 can extend through the opening 78 to guide the second end of the first link 50 and the first ends of the jaw links 52 in a reciprocating path as the tool 10 moves through the sealing cycle.

In an embodiment the tool 10 is of a single notch type. In such a tool, there is one pair of jaw elements 54 to form the notch in the strap and seal. In another embodiment, as illustrated in FIGS. 6 and 7, the tool 10 includes two pairs of jaws 154*a*, 154*b* with the jaws of one pair spaced from the jaws of the other pair by a notch plate 72. In an embodiment with multiple pairs of jaw elements, 154*a*, 154*b*, one or more pairs of the jaw elements 154*a* or 154*b* can be engaged and disengaged from the drive so that less than all of the pairs of jaw elements open and close during the sealing cycle. For example, in an embodiment with two pairs of jaw elements 154*a* and 154*b*, one pair of jaw elements 154*a* or 154*b* can be disengaged from the drive by movement of jaw 155. Those skilled in the art will recognize the double notch tool and the two pairs of tabs that are cut into the seal and strap using such a tool.

The tool 10 is configured to permit operation in a fully automatic mode. To this end, the tool 10 includes a control system, shown generally at 80, to control operation of the tool 10. In an embodiment the tool 10 includes an actuation switch 82 and one or more circuits to control the tensioner motor and the notcher motor 34. Other position switches and/or sensors, such as the illustrated strap sensor shown at 84, sense the presence of strap in the tool 10, the position of the jaws 54 and the like.

In an embodiment, the tool 10 functions in conjunction with a tool setting management system 102 and method. In such a system, the tool 10 has a stored tool setting, such as the tension to be drawn in the strap. The system 102 enables a user to modify the tool setting using a device 104 wirelessly connected to the tool 10. The tool setting management system allows a user to wirelessly pair the device 104 with the tool 10, for example, by pairing through a Bluetooth protocol. The tool 10 has at least one modifiable tool setting, for example, the strap tension, that enables the user, once the tool 10 and device 104 are in communication with each other, to input a tool setting modification, such as a change in the desired tension, into the device 102, which change is then transmitted to the paired tool 10. Upon receiving the tool setting modification, the tool controller 80 modifies the stored setting in the tool 10. An example of such a device is a smart phone, a pad or tablet device 104 that is paired with the tool 10. Such a system and method is disclosed in Figiel, U.S. Patent Application Ser. No. 62/191,087, the disclosure of which is incorporated herein in its entirety.

In an embodiment, the tool 10 includes one or more indicators, such as LEDs 86, to provide indication of certain functions and states of the tool 10. The LED indicator 86 can be positioned within or around the actuation switch 82.

In an embodiment, the tool 10 is configured having a single button actuation control system. In such a system there are no user adjustable settings on the tool. Rather, the tool has a handle 88 for opening and closing the tension wheel 40 on the strap and the button actuation switch 82 to actuate the tool 10. Other modifiable settings, such as tension level, strap size and the like are carried out using the wireless device 104.

In one operating scenario, the tool 10 is in a home position in which the spring biases the tension wheel into contact with the foot. When the battery is installed, the tool turns on and runs a self-test. An indicator, such as the LED in the actuation switch, can be configured to flash in a predetermined sequence to indicate the operating state of the tool. Once the tool completes the self-test it is in a ready/sleep state. In the ready/sleep state, the tensioner and sealer motors and are off (no power to the motors), and the tool is ready for operation.

To commence a strapping cycle, the tool is opened by urging or pulling the tensioner motor assembly toward the tensioner handle to open a gap between the tension wheel and the foot. A lead or free end of the strap is positioned around the load and a supply end of the strap (from a strap dispenser) is positioned overlapping the free end. A seal is positioned on the overlapping courses of strap at the jaws with the supply end entering from the rear end (the tension wheel end) of the tool.

In one scenario of operation, depressing and releasing the actuation switch 82 commences the operating cycle. With the overlapping strap S courses positioned between the tension wheel 40 and the foot 14 and with the seal positioned on the overlapping strap courses at the jaw elements 54, the tension cycle starts, in which the tensioner motor operates to drive the tension wheel 40 to draw tension in the strap. When a predetermined amount of tension is drawn (as set by using the tool setting management system), the tensioner motor stops.

The sealing cycle then starts, in which the sealing motor 34 operates to drive the sealing section drive wheel 48.

When power is provided to the motor 34, the output shaft rotates which in turn drives the drive belt 58. The drive belt 58 rotates the drive wheel 48 which moves the first link 50 downward. The jaw links 52 are driven away from the first link 50 which pivots the jaw elements 54 such that the pincer portions 68 move inward, toward the notch plates 72. When the drive wheel 48 has rotated approximately 180 degrees from its starting position, the jaw elements 54 are in the fully closed position, the pincers 68 contact the seal element, which crimps the seal element on the strap and cuts into the seal element and strap to form a notch in the seal element and strap. As drive wheel 48 continues to rotate beyond the 180 degree position and back toward the home position, the first link 50 is driven upward and the jaw links 52 are driven toward each other, which opens the jaw elements 54 to release the sealed strap and to return the tool 10 to the home or ready position.

In an embodiment, the tool 10 is configured having a single button actuation control system in which the tensioning and sealing cycle is commenced by a single action, for example, a single depression of an actuation switch or button. In another embodiment, such action is multiple depressions of an actuation switch or button.

In an embodiment, the actuation button 82 can also be used to stop operation of the tool 10 if, for example, the strap or seal are not properly positioned. In one operating scenario, repeated pushes of the button 82 or a single long hold down of the button 82 can stop operation of the tool 10. The button 82 can also be used to reset the tool 10 to the home position.

In an embodiment the tool can have a pretension cycle in which the tool operates to draw a lesser amount of tension, for example about 200 pounds of tension, prior to entering a full tensioning cycle. The pretension can be used to, for example, moderately tension the strap so that adjustments can be made to the position of the strap or to apply or adjust edge protectors on the load. Once the pretension cycle is complete, the tensioning and sealing cycle can commence or be completed. In an embodiment the actuation button is depressed and the tool runs through the pretension cycle. Indication can be provided by, for example, a flashing light at the actuation button indicating that the pretension cycle is complete. After the operator carries out any needed adjustment or actions (for example, applying edge protectors), the button can be depressed once again, which continues the operation, e.g., tensioning and sealing cycle, of the tool.

The tool 10 as disclosed and described is an electrically powered tool that uses a battery; it will however be appreciated that the tool 10 can be configured to operate with a voltage converter (not shown) for example, for use at line voltages (e.g., 120V-240V). In addition, although the tool 10 is described as including a tensioner motor and a sealing motor 34, it is contemplated that a single motor can be used to carry out both the tension and sealing functions with appropriate drives in place.

It will be appreciated by those skilled in the art that the relative directional terms such as sides, upper, lower, rearward, forward and the like are for explanatory purposes only and are not intended to limit the scope of the disclosure.

All patents or patent applications referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

It should be understood that various changes and modifications to the presently preferred embodiments disclosed herein will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A device for tensioning a strap and cutting notches into two ends of the strap to attach the two ends of the strap to one another, the device comprising:

first and second jaw elements defining a strap path therebetween;

third and fourth jaw elements defining the strap path therebetween;

one or more plates, wherein the first, second, third, and fourth jaw elements are each mounted to at least one of the one or more plates such that the first, second, third, and fourth jaw elements are each rotatable relative to the one or more plates between respective first, second, third, and fourth jaw element rest positions and respective first, second, third, and fourth jaw element cutting positions;

a drive element rotatable about a drive element rotational axis, wherein the drive element is engaged to the first and second jaw elements so during a sealing cycle rotation of the drive element about the drive element rotational axis in a first rotational direction results in the first and second jaw elements rotating from their respective rest positions to their respective cutting positions and, afterwards, further rotation of the drive element about the drive element rotational axis in the first rotational direction results in the first and second jaw elements rotating back to their respective rest positions; and wherein the drive element is engageable to and disengageable from the third and fourth jaw elements so:

when the drive element is engaged to the third and fourth jaw elements, during the sealing cycle rotation of the drive element about the drive element rotational axis in the first rotational direction results in the third and fourth jaw elements rotating from their respective rest positions to their respective cutting positions and, afterwards, further rotation of the drive element about the drive element rotational axis in the first rotational direction results in the third and fourth jaw elements rotating back to their respective rest positions, and when the drive element is disengaged from the third and fourth jaw elements, during the sealing cycle the third and fourth jaw elements remain in their respective rest positions;

a rotatable tensioning wheel;

an actuation switch; and a control system configured to, responsive to one or more actuations of the actuation switch, cause the tensioning wheel to rotate to carry out a tensioning cycle and, afterwards, cause the drive element to rotate in the first rotational direction to carry out the sealing cycle.

2. The device of claim 1, wherein the control system is configured to cause the tensioning wheel to rotate to carry out the tensioning cycle and, afterwards, cause the drive element to rotate in the first rotational direction to carry out the sealing cycle responsive to a single actuation of the actuation switch.

3. The device of claim 1, wherein the one or more plates comprise a first plate, a second plate, and a third plate, wherein the first and second jaw elements are between the first and second plates, wherein the third and fourth jaw elements are between the second and third plates, wherein the first and third jaw elements are mounted to the first, second, and third plates via a first connector, and wherein the second and fourth jaw elements are mounted to the first, second, and third plates via a second connector.

4. The device of claim 3, wherein the first connector comprises a first pin and the second connector comprises a second pin.

5. The device of claim 1, further comprising a housing, one or more motors operably connected to the drive element to rotate the drive element and operably connected to the tension wheel to rotate the tension wheel, and a battery receivable in the housing, wherein the one or more motors are powered by the battery and positioned between the battery and the drive element.

6. The device of claim 5, wherein the one or more plates are fixed relative to the housing.

7. The device of claim 5, wherein the at least one of the one or more motors operably connected to the drive element comprises an output shaft operably connected to the drive element, wherein the output shaft is rotatable about an output shaft rotational axis.

8. The device of claim 7, wherein the drive shaft rotational axis is parallel to the drive element rotational axis.

9. The device of claim 8, wherein the drive shaft rotational axis is parallel to the strap path.

10. The device of claim 7, further comprising gearing operably connecting the output shaft to the drive element.

11. The device of claim 1, wherein rotation of the drive element about the drive element rotational axis in the first rotational direction approximately 360 degrees from a starting position results in:

the first and second jaw elements rotating from their respective rest positions to their respective cutting positions and, afterwards, back to their respective rest positions; and when the drive element is engaged to the third and fourth jaw elements, the third and fourth jaw elements rotating from their respective rest positions to their respective cutting positions and, afterwards, back to their respective rest positions.

12. The device of claim 11, wherein rotation of the drive element about the drive element rotational axis in the first rotational direction approximately 180 degrees from the starting position forces:

the first and second jaw elements to rotate from their respective rest positions to their respective cutting positions; and when the drive element is engaged to the third and fourth jaw elements, the third and fourth jaw elements to rotate from their respective rest positions to their respective cutting positions.

13. The device of claim 1, wherein the drive element is positioned so the drive element rotational axis is above and between the first and second jaw elements and above and between the third and fourth jaw elements.

14. The device of claim 1, further comprising a first jaw linkage connected to the first jaw element, a second jaw linkage connected to the second jaw element, and a connector connected to the first and second jaw linkages, wherein the drive element comprises a cam, wherein the cam is engaged to the first and second jaw elements via the first and second jaw linkages and the connector.

15. The device of claim 14, wherein the connector comprises a central linkage pinned to the cam.

16. The device of claim 1, wherein the first jaw element comprises a first pincer end, the second jaw element comprises a second pincer end, the third jaw element comprises a third pincer end, and the fourth jaw element comprises a fourth pincer end, wherein the first, second, third, and fourth pincer ends are not in the strap path when the first, second, third, and fourth jaw elements are in their respective rest positions and are in the strap path when the first, second, third, and fourth jaw elements are in their respective cutting positions.

17. The device of claim 1, wherein the drive element is engaged to the first and second jaw elements so rotation of the drive element about the drive element rotational axis in the first rotational direction and from a starting position forces the first and second jaw elements to rotate from their respective rest positions to their respective cutting positions, wherein when the drive element is engaged to the third and fourth jaw elements, rotation of the drive element about the drive element rotational axis in the first rotational direction and from the starting position forces the third and fourth jaw elements to rotate from their respective rest positions to their respective cutting positions.

18. The device of claim 17, wherein the drive element is engaged to the first and second jaw elements so, when the first and second jaw elements are in their respective cutting positions, further rotation of the drive element about the drive element rotational axis in the first rotational direction back to the starting position forces the first and second jaw elements to rotate from their respective cutting positions to their respective rest positions, wherein when the drive element is engaged to the third and fourth jaw elements, rotation of the drive element about the drive element rotational axis in the first rotational direction back to the starting position forces the third and fourth jaw elements to rotate from their respective cutting positions to their respective rest positions.

* * * * *